United States Patent [19]

Aso et al.

[11] 4,278,124

[45] Jul. 14, 1981

[54] METHOD OF PRODUCING HOLLOW STEEL INGOT AND APPARATUS THEREFOR

[75] Inventors: Kazuo Aso, Okayama; Takesaburo Nishioka, Tokyo; Takemi Yamamoto; Naomichi Miyai; Jun-ichi Matsuno, all of Okayama, Japan

[73] Assignee: Kawasaki Steel Corporation, Hyogo, Japan

[21] Appl. No.: 23,892

[22] Filed: Mar. 26, 1979

[30] Foreign Application Priority Data

Apr. 11, 1978 [JP] Japan ..... 53-42410
Sep. 25, 1978 [JP] Japan ..... 53-118376

[51] Int. Cl.[3] ..... B22D 27/04

[52] U.S. Cl. ..... 164/125; 164/348; 164/369

[58] Field of Search ..... 164/125–128, 164/348, 132, 137, 369, 85

[56] References Cited

U.S. PATENT DOCUMENTS 1,894,983 1/1933 Eppensteiner ..... 164/348
2,025,336 12/1935 Brearley ..... 164/132

FOREIGN PATENT DOCUMENTS 47-34579 8/1972 Japan ..... 164/85
50-28898 9/1975 Japan ..... 164/348

*Primary Examiner*—Robert D. Baldwin
*Assistant Examiner*—K. Y. Lin
*Attorney, Agent, or Firm*—Koda and Androlia

[57] ABSTRACT

The casting apparatus for a hollow steel ingot is constructed such that: at least three concentric pipes are provided in the central portion of an ordinary mold for a steel ingot; a core is formed by filling up a space formed between the first outer-most pipe having the largest diameter and the second pipe disposed inwardly of the first pipe with granular refractory material wherein zircon or chromite sand is bound by a binder such as an organic resin; a double pipe is disposed inwardly of said core and forming a gas flow course for cooling the core; and pouring gates formed through the stool for feeding molten steel at an intermediate portion between the inner wall of said mold and the core. The method for producing a hollow steel ingot by use of the casting apparatus as described above comprises: blowing the cooling gas from above into the third inner-most pipe having the least diameter, passing the gas through the second pipe from below and discharging it to above; cooling the molten steel fed into the mold and brought into contact with the outer surface of the first pipe by cooling the core through the inner wall of the second pipe; and controlling the cooling conditions for the core such as the thickness of the cylindrical refractory material of the core, the cross-sectional area of the cooling gas flow course and the thickness of the second pipe so that the finally solidifying position of the molten steel fed can be set at a position which is apart from the core side at a distance of 20 to 50% of the wall thickness of the hollow steel ingot to be formed.

8 Claims, 7 Drawing Figures

METHOD OF PRODUCING HOLLOW STEEL INGOT AND APPARATUS THEREFOR

FIELD OF THE INVENTION

The present invention relates to a method of producing hollow steel ingot and an apparatus therefor, and more particularly, to a method of producing a large hollow steel ingot with sound interior quality for use as a forging material for a large cylindrical body and the like and an apparatus therefore.

DESCRIPTION OF THE PRIOR ART

It is readily understandable that, in general, as the material steel ingot in the case of manufacturing a cylindrical forging such as a pressure vessel material, the use of a hollow steel ingot is by for more efficient than the use of an ordinary steel ingot. However, heretofore, the technique in manufacturing hollow steel ingots, particularly large hollow steel ingots have not been established, and important cylindrical forgings have been manufactured by the use of big-end up solid steel ingot of polygonal cross section through machining after being subjected to a complicated process comprising the steps of:

grip forging;
upsetting;
solid forging;
upsetting and punching;
bore enlarging; and
mandrelling.

Consequently, lowered forging yield and increased heating expenses lead to increased forging costs, thus resulting in very high manufacturing costs. In contrast with this, in the use of a hollow steel ingot, machining can be applicable to it immediately after undergoing a few steps such as bore enlarging and mandrelling, thus enabling expect improved yield and lowered forging cost to a considerable extent.

Heretofore, a variety of methods of producing hollow steel ingots having advantages as described above have been proposed, and typical methods shown below are included therein.

(a) A method wherein a water-cooled core rotatable in the central portion of a mold, molten steel is fed into a portion between the mold and the core, and, after a solidifying wall contacting the core has grown to a certain extent, the core is progressively elevated to be drawn.

(b) A method of providing a metal core or a sand-mold core in the central portion of a mold.

(c) A method by centrifugal casting.

(d) A method wherein a metal plate core being a circle or deformed shape in horizontal cross-section is provided at the central portion of a mold, the interior of said metal plate core is made hollow and cooling water or cooling gas is blown thereinto, radiant heat absorbing substance is put or stuffed thereinto, thereby controlling the solidifying conditions of molten steel. (Japanese Patent Application Publication No. 28898/75). However, there have been encountered problems in complicated manufacture and installation of the core, unsatisfactory surface quality of the hollow ingot products, increased segregation of the interior quality of the ingot due to insufficient cooling and the like. Particularly, many problems are encountered in the production of hollow ingots larger in weight than 100 tons, and satisfactory products have not been reliably obtained.

BRIEF SUMMARY OF THE INVENTION

One object of the present invention is to obviate the abovementioned disadvantages of the prior art in the production of hollow steel ingots and provide a method of producing hollow steel ingots excellent in the qualities of the surface and interior.

Another object of the present invention is to provide an apparatus for casting hollow steel ingots, wherein said apparatus has construction of core meeting four requirements shown below, the core is not damaged by static pressure of molten steel fed into the mold, and the core is efficiently cooled during producing hollow steel ingots.

(a) Arrangements for producing and installing cores and easily made.

(b) Cooling of the core can be effected quick and suitably controlled.

(c) The core can be readily taken out after the steel ingot has been solidified.

(d) No cracking is caused to the interior of the steel ingot due to solidifying and shrinking stress, and construction of the core is suitable for obtaining a steel ingot product having excellent surface quality.

The most important problem in producing hollow steel ingots resides in the construction of the mold, and particularly, in the construction of the core. Study on the problems of the mold including the core made by the present invention has led to the conclusion that the above-mentioned four items are vital.

Said objects, other objects and advantages of the present invention will hereafter be made evident in conjunction with the detailed description of the present preferred embodiment of the invention illustrated in the accompanying drawings. However, it is to be understood that the drawings are merely illustrative but not limitative in the scope of the present invention.

The aforesaid objects of the present invention can be achieved by the present invention having the following gist.

The gist of the present invention resides in that

A method of producing a hollow steel ingot, wherein a cylindrical core is disposed in the central portion of a cast iron mold installed on a stool and molten steel is fed into said mold by bottom pouring, characterized in that said core comprises a cylindrical refractory member formed of granular refractory material and steel pipes covering the outer and inner surfaces of said cylindrical refractory member, the inner surface of said core is cooled by a gas stream, and the finally solidifying position of said molten steel fed is restricted to a distance of 20 to 50% of the wall thickness of the steel ingot from the side of said core, and a casting apparatus for producing a hollow steel ingot, wherein said apparatus comprises a cast iron mold installed on a stool, a cylindrical core disposed in the central portion of said mold and pouring gates formed through the stool for feeding molten steel at intermediate portions between the inner wall of said mold and the core, wherein, said apparatus comprises:

a first steel pipe disposed in the central portion of said mold;

a second steel pipe provided inside said first steel pipe and concentrically therewith;

a core formed of granular refractory material filled up in a space formed between said first and second steel pipes;

a third steel pipe provided inside said second steel pipe and concentrically therewith; and a gas flow course for cooling the core descending into said third steel pipe from above and then ascending inside said second steel pipe.

DETAILED DESCRIPTION OF THE INVENTION

Description will hereunder be given of the method of producing a hollow steel ingot and the apparatus therefor according to the present invention in conjunction with the embodiments thereof.

Figure 1:
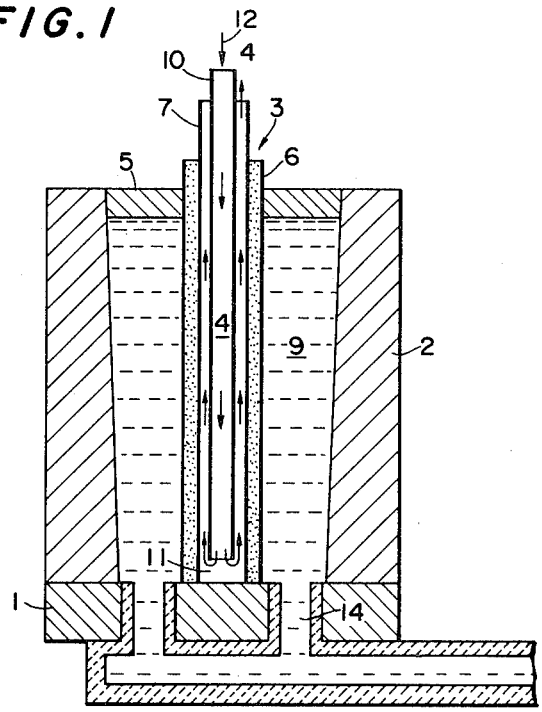
FIG. 1 is a longitudinal section showing one embodiment of the casting apparatus for producing a hollow steel ingot according to the present invention.

FIG. 1 is a longitudinal section showing the casting apparatus for producing hollow steel ingots according to the present invention. Namely, said casting apparatus comprises a casting mold 2 installed on a stool 1, a core 3 disposed in the central portion of the casting mold 2, a gas flow course 4 for cooling the core provided further inside the core 3, and pouring gates 14 formed through the stool 1 for feeding molten steel 9 at intermediate portions between the mold 2 and the core 3. Said core 3 and the gas flow course 4 for cooling the core are fixed at the upper end of the mold 2 through a support fitting 5 so as not to be lifted up into molten steel.

The core 3 comprises a first steel pipe 6 disposed in the central portion of the casting mold 2, a second steel pipe 7 provided inside said first steel pipe 6 and concentrically therewith, and granular refractory material 8 such as molding sand filled up in the space formed between the first and second steel pipes, and the outer surface of the first steel pipe 6 is brought into direct contact with molten steel 9 fed into the mold 2.

The gas flow course 4 for cooling the core provided inside the core 3 by utilizing the inner surface of the second steel pipe 7 and the third steel pipe 10 . More specifically, a gap 11 is provided between the lower end of the third steel pipe 10 and the stool 1. The gas 12 for cooling the core is introduced from above the third steel pipe 10, descends through the third steel pipe 10, passes through the gap 11 between the third steel pipe 10 and the stool 1, ascends through a space formed between the second and third steel pipes 6 and 7, and discharged upward, thereby generally forming the gas flow course 4 for cooling the interior of the second steel pipe 6.

The followings are the problems to be encountered in producing the hollow steel ingots by use of the casting apparatus with the above arrangement according to the present invention.

(a) The thickness of the first steel pipe (b) Construction of the second steel pipe (c) Type and structure of the refractory material of the core (d) Means for cooling the core (e) The relationship between the thickness of the refractory material of the core and the finally solidifying position of molten steel Description will hereunder be given of the above-mentioned problems.

(a) The Thickness of the First Steel Pipe

Since the first steel pipe 6 used as the core 3 comes into direct contact with molten steel fed into the mold 2, it needs to have resistance to melting loss. Hence, it is preferable to use a low-carbon steel pipe having a higher melting point than that of molten steel 9 to be cast. Further, the first steel pipe 6 needs to be removed from the surface of the hollow steel ingot produced as the scales by heating for 5 to 10 hours during forging, and the resistance to melting loss is required as described above, and hence, the thickness of the first steel pipe 6 may be 5 to 20 mm, preferably 8 to 10 mm.

(b) Construction of the Second Steel Pipe

Figure 3:
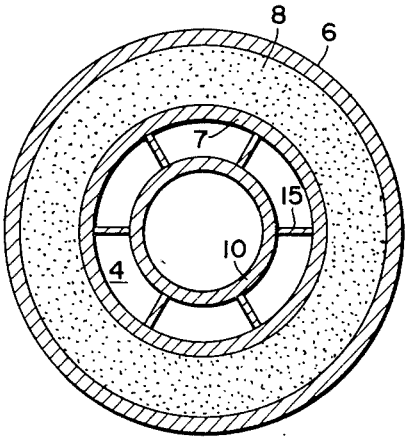
FIG. 3 is a cross-section enlargedly showing another embodiment of the casting apparatus according to the present invention, wherein radial reinforcing ribs are provided in the gas flow course for cooling the core.

It is desirable that the thickness of the second steel pipe 7 is as thin as possible from the viewpoint of cooling effect by use of gas cooling. On the other hand, it needs to have mechanical strength sufficient to bear the static pressure of molten steel 9 and prevent the collapse of the core. From this reason, particularly, with the casting apparatus for producing large hollow steel ingots, it is preferable to provide a plurality of reinforcing ribs 15 between the first steel pipe 6 and the second steel pipe 7 in the radial direction as shown in FIG. 3. The number of the reinforcing ribs depends on the thickness of the second steel pipe 7, and at least 4 to 6 reinforcing ribs are preferable as shown in FIG. 3. Said reinforcing ribs 15 are required to merely support the second steel pipe 7 and the third steel pipe 10 in the radial direction, and therefore, the reinforcing ribs need not to be fixed by welding and the like.

The results of experiments conducted by the present inventors have been shown that the upper limit of the elevated temperature of the second steel pipe when the hollow steel ingot was produced is 780° C. Therefore, assuming that the maximum temperature is 800° C., the required thickness of the second steel pipe 7 for bearing the static pressure of molten steel has been calculated. As the result, it has been found that, in order to obtain the thickness of the second steel pipe, the following formulae (1) and (2) may be satisfied for buckling breaking and the following formula (3) may be satisfied for compressive breaking.

$$t \geqq 0.030[H/(n^2-1)]^{\frac{1}{4}} \cdot R \quad (1)$$

wherein $n \geqq 2$, equation (1) is satisfied for buckling $$t \geqq 0.020H^{\frac{1}{2}} \cdot R \quad (2)$$

wherein $n \geqq 1$, equation (2) is satisfied for buckling $$t \geqq 0.0047HR \quad (3)$$

for compressive braking equation (3) is satisfied wherein, t: the thickness (cm) of the second steel pipe,
H: the height (m) of the hollow steel ingot,
n: the number of the reinforcing ribs
R: the inner radius (cm) of the second steel pipe (c) Type and Structure of the Refractory Material of the Core The refractory material 8 filled up in the space formed between the first steel pipe 6 and the second steel pipe 7 needs to be satisfactorily high refractoriness and not to cause seizure so that shrinkage of the hollow steel ingot due to solidification can be absorbed and the removing of the second steel pipe 7 can be facilitated after the completion of solidification.

When seizure is caused, it is difficult to separate the hollow steel ingot from the core and the hollow steel ingot cannot be subjected to forging.

In this respect, granular refractory materials having refractoriness of 1100° C. and more such as zircon sand, silica sand and chromite sand are combined by an organic binder such as furan resin and urethane resin are useful. Particularly useful is the refractory material in which zircon sand and chromite sand are combined by a furan resin.

Table 1 shows one embodiment of the chemical composition and grain sizes of silica sand, zircon sand and chromite sand, which are usable in the present invention.

(d) Means for Cooling the Core

Figure 2:
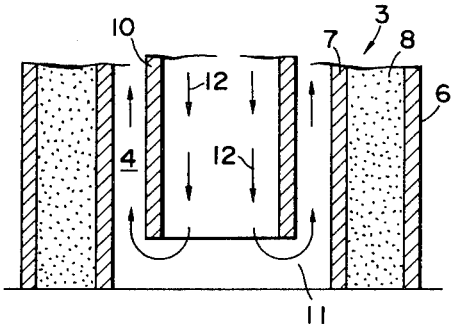
FIG. 2 is a longitudinal section enlargedly showing the core and the gas flow course for cooling the core in the casting apparatus according to the present invention.

As shown in FIGS. 1 and 2, the core 3 according to the present invention is cooled from inside. The purposes of cooling the core include restricting the finally solidifying position of molten steel to a distance of 20 to 50% of the wall thickness of the steel ingot from the side of said core 3, preventing the second steel pipe 7 from being heated, decreased in strength and finally deformed to a considerable extent by the heat of casting the steel ingot, and contributing to smooth heat radiation from the interior of steel ingot to avoid sintering of the refractory material.

As the means of cooling, natural convection, spray cooling, gas cooling and the like are conceivable, and it is preferable to adopt such type of cooling that in which the coefficient of heat-transfer are selected over a wide range and industrially easily workable means such as air or nitrogen gas stream is used. If the flow rate of the gas stream is set within a range from 0.5 to 5 m/sec, preferably 0.8 to 2 m/sec, then the temperature of the second steel pipe 7 can be kept at about 780° C. maximum, thereby enabling to avoid the breaking thereof.

Furthermore, as the result of calculating the heat transfer, it has been found that, in order to prevent the temperature of the cooling gas 12 in the flow course 4 from being raised so as to ensure the cooling effect, the cross-sectional area S of the flow course 4 should satisfy the following formula (4).

$$S > 5.9\ HR \quad (4)$$

wherein,

S: the cross-sectional area ($cm^2$) of the cooling gas flow course
H: the height (m) of the hollow steel ingot,
R: the inner radius (cm) of the second steel pipe (e) The Relationship Betweeen the Thickness of the Core Refractory Material and the Finally Solidifying Position of Molten Steel

TABLE 1

| Refractory material Type | Chemical composition (Weight %) | | | | | | | | | | Mean grain fineness number |
|---|---|---|---|---|---|---|---|---|---|---|---|
| | $SiO_2$ | $ZrO_2$ | $Cr_2O_3$ | $Al_2O_3$ | $Fe_2O_3$ | CaO | MgO | $TiO_2$ | $P_2O_5$ | Ignition loss | |
| Silica sand | 98.3 | — | — | 0.90 | 0.17 | 0.15 | 0.09 | — | — | 0.03 | 108 |
| Zircon sand | 33.6 | 65.8 | — | 0.3 | 0.05 | — | — | 0.3 | 0.01 | — | 111 |
| Chromite sand | 1.6 | — | 45.3 | 14.7 | 25.1 | — | 10.1 | 0.6 | — | — | 116 |

The term "grain fineness number" in Table 1 refers to the value digitally indicating the particle size distribution of the sand grain groups prescribed in JIS Z-2602.

It is one of the features of the present invention that the granular refractory material such as a silica sand, zircon sand or chromite sand is used as the refractory material 8 of the core 3 and the organic resin is used as the binder as described above. According to the present invention, said core does not come into direct contact with molten steel 9, however, is heated to a high temperature by the molten steel 9 and completely burned up by using the organic binder upon feeding of the molten steel 9. Consequently, no seizure takes place with the granular refractory material and the knock-out work due to the removing of the second steel pipe 7 becomes very easy when the hollow steel ingot is drawn.

The thickness of the granular refractory material 8 filled up in the space formed between the first steel pipe 6 and the second steel pipe 7 is determined as follows depending upon the three conditions including the quality of the refractory material, the method of cooling the second steel pipe 7 and the finally solidifying position of the steel ingot.

Figure 4:
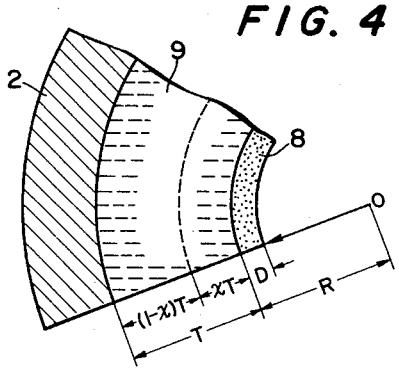
FIG. 4 is an explanatory view for the calculation of the formula on the relationship between the finally solidifying position of molten steel fed into the casting apparatus and the thickness of the core according to the present invention.

FIG. 4 is a partial cross-sectional view showing the relationship between the mold 2, the core refractory material 8 and the finally solidifying position of molten steel 9 during production of the hollow steel ingot. Now, assume that the thickness of molten metal 9 is T, the thickness of the refractory material 8 is D, the inner radius of the hollow steel ingot is R, the finally solidifying position of molten steel is a distance d apart from the core and d=xT, then said finally solidifying position will be (1=x)T apart from the inner wall of the mold 2.

The relationship between the thickness D of the refractory material and the finally solidifying position of molten steel can be obtained as follows by the calculation of heat-transfer in the case of the solidification wherein the temperature of molten steel is 1500° C. and that of the cooling gas is 20° C.

$$D = k\left\{\frac{0.35aR(1-x)^2}{x(2+ax)} - \frac{1}{\alpha}\right\} \quad (5)$$

wherein a=T/R, $\alpha$ is the coefficient of heat-transfer and k is the thermal conductivity. The values of $\alpha$ and k are substantially as follows:

$\alpha$: 100 to 1500 Kcal/m²·h·°C. in the case of gas cooling k: 0.30 Kcal/m·h·°C. for chromite sand, 0.26 for zircon sand and 0.20 for silica sand.

Figure 5:
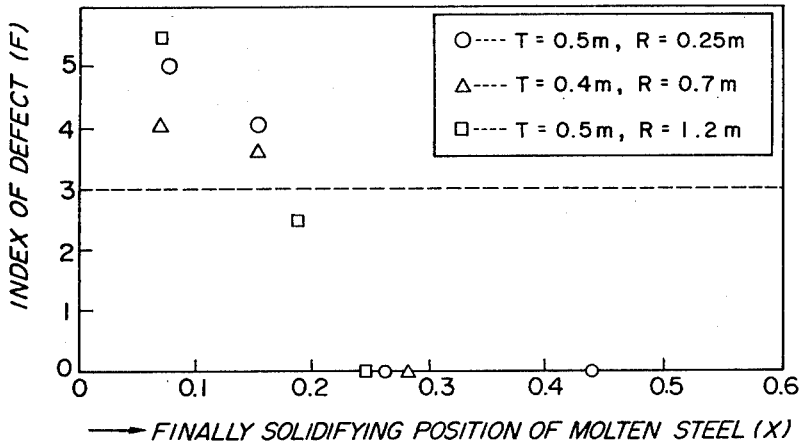
FIG. 5 is a view of the correlation showing one example of the relation between the finally solidifying position ($x=d/T$) of molten steel in the mold and the index of defect F of the hollow steel ingots produced.

The present inventors produced the hollow steel ingots having the finally solidifying position of x=0.05~0.5 at last by varying the cooling rate on the core side, using hollow steel ingots having various shapes, subjected said hollow steel ingots to forging from inside and outside, and thereafter, conducted the flaw detecting dyeing test on said hollow steel ingots. FIG. 5 show the results of the test. In FIG. 5, the index of defect F is the index for indicating the magnitude of defect, and the products having F larger than 3 are not usable. As apparent from FIG. 5, in the case the finally solidifying position is not spaced apart from the core side at a distance of 20% or more of the thickness T of the steel ingot, no matter what shape the hollow steel ingot may have, it is not usable. Namely, if the cooling at the inner surface of the core 3 is unsatisfactory and the finally solidifying position is not spaced apart from the core side a distance of 0.2 of the wall thickness T of the steel ingot, there is a high possibility of that defects may appear when the hollow steel ingot product is subjected to inner surface finishing. However, the more the finally solidifying position approaches the center of the wall thickness T of the hollow steel ingot, i.e. x=0.5, the less the forced cooling is needed.

Consequently, it was found that the finally solidifying position should be limited to the formula of $0.2 \leqq x \leqq 0.5$. If this limiting requirement is substituted for the formula (5) and the upper and lower limits of the coefficient of heat-transfer $\alpha$ by gas cooling is made to be $100 \leqq \alpha$ (Kcal/m²·h·°C.)$\leqq 1500$, then, the upper and lower limits of the thickness D of the core refractory material 8 can be calculated as follows:

(a) when the inner radius of the steel ingot is R<0.5 m $$k\left\{\frac{0.044a}{2+0.5a} - \frac{1}{100}\right\} \leqq D \leqq k\left\{\frac{0.14a}{2+0.2a} - \frac{1}{1500}\right\} \quad (6)$$

(b) $0.5 \leqq R < 1.0$ $$k\left\{\frac{0.13a}{2+0.5a} - \frac{1}{100}\right\} \leqq D \leqq k\left\{\frac{0.42a}{2+0.2a} - \frac{1}{1500}\right\} \quad (7)$$

(c) $1.0 \leqq R < 2.0$ $$k\left\{\frac{0.26a}{2+0.5a} - \frac{1}{100}\right\} \leqq D \leqq k\left\{\frac{0.84a}{2+0.2a} - \frac{1}{1500}\right\} \quad (8)$$

It has been already described, that the thermal conductivity k (Kcal/m·h·°C.) obtainable through the above formula varies depending upon the types of the refractory material used, and, as far as the types of the refractory material used in the present invention are concerned, the thermal conductivities are 0.20 for silica sand, 0.26 for zircon sand and 0.30 for chromite sand.

The present inventors, in the production of the hollow steel ingots various in inner diameter R by use of the casting apparatus according to the present invention as shown in FIG. 1, used the cores 3 having the thickness of the refractory material 8 calculated by the above-mentioned formulae (6), (7) and (8), fed molten steel under gas cooling, cut the hollow steel ingot after cooling, and determined the finally solidifying position by etching for macro-inspection. The results have satisfactorily coincided with the result of calculation, thereby enabling to prove the reasonableness of the calculating method adopted by the present inventors.

As described above, if the thickness (D) of the refractory material is selected, then it is possible to set the finally solidifying position of the steel ingot which is apart from the core side at a distance of 20 to 50% of the wall thickness (T) of the steel ingot. In order to set the finally solidifying position deeply, it is necessary to make the wall thickness (T) of the steel ingot as thin as possible. However, as viewed from the workability in filling the refractory material between the first steel pipe 6 and second steel pipe 7 and the fact that, when the layer of refractory material is too thin, the refractory material is sintered with the result that the core becomes difficult to be removed after the steel ingot has been solidified and also the shrinkages cannot be absorbed to thereby cause cracking, the thickness of 20 mm or more is practically necessary.

From the results of tests in practical casting and the conclusion derived from the formulae (6), (7) and (8), 100 mm is given as the maximum thickness of the refractory material. Consequently, the range from 20 to 100 mm is preferable for the thickness of the core refractory material of the ordinary hollow steel ingots.

EXAMPLE 1

Using a Cr-Mo steel containing in weight 0.08% C, 0.06% Si, 0.38% Mn, 2.05% Cr, 0.96% Mo, 0.011% P and 0.004% S, a 20 ton hollow steel ingot was produced according to the present invention.

The principal dimensions of the casting apparatus are as follows:

| | |
|---|---|
| Outer diameter of the first steel pipe 6 of the core | 500mm |
| Outer diameter of the second steel pipe 7 of the core | 440mm |
| Thickness (t) of the second steel pipe 7 of the core | 10mm |
| Height (H) of the hollow steel ingot | 1530mm |
| Height of the mold | 1800mm |
| Inner diameter of the lower end of the mold | 1417mm |
| Inner diameter of the upper end of the mold | 1600mm |
| Number (n) of the reinforcing ribs | 1 |
| Thickness (D) of the core refractory material | 20mm |

Using the casting apparatus of the above-mentioned specification according to the present invention and the core refractory material in which chromite sand was bound by furan resin, molten steel was fed from bottom with air for cooling the core being supplied at the flow rate of 4 m/sec. The temperature of molten steel at the time of casting was 1595° C. and the required casting time was 9 min.

The 20 ton hollow steel ingot thus obtained according to the present invention was cut along the plane passing through the diameter of said steel ingot and studies were made on the state of segregation of C, the finally solidifying position of the molten steel and the structure of the steel adjacent the finally solidifying position.

Figure 6:
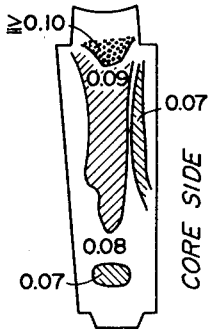
FIG. 6 is a longitudinal section taken along the line of diameter of the steel ingot and showing the finally solidifying position of the hollow steel ingot of 20 tons and the state of segregation of C in Example 1 and FIG. 7 is a longitudinal section taken along the line of diameter of the steel ingot of 45 tons and the state of segregation of C in Example 2.

As for the state of segregation of C at the cross-section of said hollow steel ingot, as shown in FIG. 6, the maximum segregation rate was about 20% even immediately beneath the feeder head, and this value is lower than the maximum segregation rate of the solid steel ingot having the weight equal thereto, thereby ensuring the excellent interior quality.

Furthermore, from FIG. 6 showing the state of segregation of C, it has been proven that the finally solidifying position of molten steel of said hollow steel ingot is set substantially at the center plane of the steel ingot equalling to $x \approx 0.5$ in FIG. 4, i.e. at a position of substantially 50% of the wall thickness T of the steel ingot from the core side.

Additionally, porous parts never appear in said hollow steel ingot which are liable to appear in the finally solidifying positions of ordinary solid steel ingots due to high rate of solidification and high concentration of the dissolved substances, thereby enabling to obtain a highly sound hollow steel ingot.

EXAMPLE 2

Using a Cr-Mo steel containing in weight 0.12% C, 0.07% Si, 0.45% Mn, 5.02% Cr, 0.59% Mo, 0.011% P and 0.005% S, a 45 ton hollow steel ingot was produced according to the present invention.

The principal dimensions of the casting apparatus in this case are as follows:

| | |
|---|---|
| Outer diameter of the first steel pipe 6 of the core | 700mm |
| Outer diameter of the second steel pipe 7 of the core | 600mm |
| Thickness (t) of the second steel pipe 7 of the core | 10mm |
| Height (H) of the hollow steel ingot | 2320mm |
| Height of the mold | 2718mm |
| Inner diameter of the lower end of the mold | 1706mm |
| Inner diameter of the upper end of the mold | 1995mm |
| Number (n) of the reinforcing ribs | 4 |
| Thickness (D) of the core refractory material | 40mm |

Using the casting apparatus of the above-mentioned specification according to the present invention and the core refractory material in which chromite sand was bound by urethane resin, molten steel was fed according to the present invention with nitrogen gas for cooling the core being supplied at the flow rate of 2 m/sec. The temperature of molten steel at the time of casting was 1595° C. and the required casting time was 14.5 min.

The 45 ton hollow steel ingot thus obtained according to the present invention, in the same manner as in the Example 1, was cut along the plane passing through the diameter of said steel ingot and studies were made on the state of segregation of C, the finally solidifying position of the molten steel and the structure of the steel adjacent the finally solidifying position.

Figure 7:
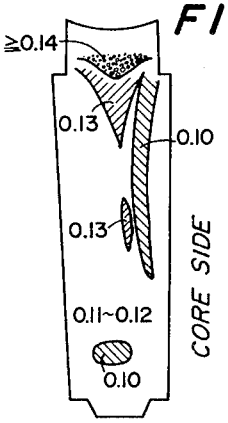

As for the state of segregation of C at the cross-section of said hollow steel ingot, as shown in FIG. 7, the maximum segregation ratio was about 20% even immediately beneath the feeder head, thereby ensuring excellent interior quality. The maximum ratio is defined as a ratio percentage of a difference between the maximum content of an element and the ladle analysis of the element to the ladle analysis content of the element.

Furthermore, from FIG. 7 showing the state of segregation of C, it has been proven that the finally solidifying position of molten steel of said hollow steel ingot is set at $x \approx 0.45$ in FIG. 4, i.e. at a position of substantially 45% of the wall thickness T of the steel ingot from the core side.

Additionally, little porous parts appear in the vicinity of the finally solidifying position, thereby enabling to obtain a highly sound hollow steel ingot.

EXAMPLE 3

Using a low alloy steel containing in weight 0.2% C, 0.35% Si, 1.40% Mn, 0.75% Ni, 0.11% Cr, 0.54% Mo, 0.008% P and 0.002% S, a 200 ton hollow steel ingot was produced according to the present invention.

The principal dimensions of the casting apparatus in this case are as follows:

| | |
|---|---|
| Outer diameter of the first steel pipe 6 of the core | 1000mm |
| Outer diameter of the second steel pipe 7 of the core | 800mm |
| Thickness (t) of the second steel pipe 7 of the core | 20mm |
| Height (H) of the hollow steel ingot | 2942mm |
| Inner diameter of the lower end of the mold | 3100mm |
| Inner diameter of the upper end of the mold | 3500mm |
| Number (n) of the reinforcing ribs | 8 |
| Thickness (D) of the core refractory material | 80mm |

Using the casting apparatus of the above mentioned specification according to the present invention and the core refractory material in which silica sand is bound by furan resin, molten steel was fed according to the present invention with nitrogen gas for cooling the core being supplied at the flow rate of 0.8 m/sec. The temperature of molten steel at the time of casting was 1595° C. and the required casting time was 35 min.

The 200 ton hollow steel ingot thus obtained according to the present invention, in the same manner as in the Example 1, was cut and studies were made on the state of segregation of C, the finally solidifying position of the molten steel and the structure of the steel adjacent the finally solidifying position.

As for the state of segregation of C at the cross-section of said hollow steel ingot, the maximum segregation ratio was about 30% immediately beneath the feeder head. And, although there was seen such a tendency similar to the conventional solid steel ingots that the maximum segregation rate increases with the increase in the weight of steel ingot, said 200 ton hollow steel ingot has by far less maximum segregation rate than 40 to 42% of the conventional solid steel ingots having the weight equalling thereto, thereby enabling to obtain a hollow steel ingot having excellent interior equality.

Furthermore, it has been proven that the finally solidifying position of molten steel is set at $x \approx 0.35$, i.e. at a position of substantially 35% of the wall thickness T of the steel ingot from the core side.

Additionally, sparcely distributed shrinkage cavities each having a diameter of 2 to 3 mm appear in the vicinity of the finally solidifying position, and accordingly, the porous part were less significant than the conventional solid steel ingots having the weight equalling thereto, thereby enabling to obtain a highly sound 200 ton hollow steel ingot.

As is apparent from the above-described examples, the following advantages have been attained by use of the method of producing a hollow steel ingot and an apparatus therefor according to the present invention.

(a) The finally solidifying position of the hollow steel ingots produced according to the present invention is set at a position 0.2 to 0.5 of the wall thickness T of the steel ingot apart from the side surface of the core, thus enabling to obtain hollow steel ingots having highly sound interior and surface qualities.

(b) The most proper thickness of the core can be readily calculated depending on the shapes and dimensions of the hollow steel ingots to be produced, so that the selection of types of the refractory material and the arrangement for producing the core may be very easily made.

(c) The cores can be easily removed after the steel ingot has been solidified, the inner surface of the steel ingot is clean because the inner surfaces of the core are covered by the steel pipes, and the remaining steel pipes can be readily removed as scales by heating before the hollow steel ingot is forged.

(d) According to the present invention, air or other inert gases are used for cooling the inner surface of the core, and hence, the work of feeding molten steel is performed very safely as compared with other methods of cooling and the cooling effect is comparatively high as well.

In addition, it has been found that, in comparison between the hollow steel ingot produced according to the present invention and the conventional solid steel ingot in the costs of material, of heating and of forging all of which are required from the materials for producing the forgings having the shapes and weights identical with each other, use of the hollow steel ingot according to the present invention is by far more advantageous in every respect as shown in Table 2.

TABLE 2

| | Solid steel ingot | Hollow steel ingot |
|---|---|---|
| Material cost rate | 100 | 85 |
| Heating cost rate | 100 | 50 |
| Forging cost rate | 100 | 70 |

Further, the result of comparison is shown in Table 3 which has been made between said hollow steel ingot and said solid steel ingot in the weight of steel ingot required for obtaining the forgings equalling in weight to each other and also in the time required for solidification.

TABLE 3

| Forging | Required weight of ingot steel (t) | | Solidifying time of steel ingot (h) | |
|---|---|---|---|---|
| Weight (t) | Solid steel ingot | Hollow steel ingot | Solid steel ingot | Hollow steel ingot |
| 15 | 25 | 20 | 7 | 3 |
| 35 | 60 | 45 | 10 | 3.5 |
| 70 | 120 | 90 | 14 | 8 |
| 110 | 175 | 140 | 23 | 10 |

As apparent from Tables 2 and 3, the advantage of using a hollow steel ingot for producing a hollow forging is profound, particularly in producing a large forging.

It should be understood that the embodiments or examples described in the item of the detailed description of the present invention are intended to illustrate the technical contents of the present invention only and not limit the invention to the specific forms to be confined in a narrow sense. All such variations and modifications as are in accord with the principles described are meant to fall within the scope of the appended claims without departing from the spirit of the invention.

What is claimed is:

1. A method of producing hollow steel ingots comprising the steps of:

disposing a cylindrical core in a central portion of a cast iron mold installed on a stool wherein said core comprises a first steel pipe disposed in the central portion of said mold, a second steel pipe is disposed within said first steel pipe and concentrically therewith, a cylinder of granular refractory material filling up the space formed between said first and second steel pipes and a third steel pipe further disposed within said second steel pipe and concentrically therewith;

feeding molten steel from below into said mold; and cooling the inner surface of said core with a gas stream descending into said third pipe from above and ascending inside the second pipe such that the finally solidifying position of the molten steel fed is set at a position which is apart from said core at a distance of 20% to 50% the wall thickness of said steel ingot.

2. A method of producing a hollow steel ingot comprising the steps of:

preparing a mold assembly including a cast iron mold installed on a stool and a core disposed in the center portion of said mold, said core comprising a first steel pipe disposed in the center portion of said mold, a second steel pipe disposed within said first steel pipe and concentrically therewith, a cylinder of granular refractory material filling up the space formed between said first and second steel pipes and a third steel pipe further disposed within said second steel pipe and concentrically therewith;

pouring molten steel into a space formed by said mold assembly through the bottom of said mold assembly and solidifying same; and cooling said core by a gas stream descending into said third pipe from above and ascending inside the second pipe throughout said process of the pouring and solidification of the molten steel and wherein the thickness of said refractory material and the conditions required for cooling the core are suitably selected so that the finally solidifying position of the molten steel poured into said mold assembly can be set at a position which is apart from the outer wall of said core at a distance of 20% to 50% of the wall thickness of the steel ingot to be formed.

3. A method of producing a hollow steel ingot as set forth in claim 2, wherein the thickness of said cylindrical refractory material is limited to the range satisfying the following formulae (1), (2) and (3):

(a) When the inner radius (R) of the steel ingot is less than 0.5 m $$k\left\{\frac{0.044a}{2+0.5a}-\frac{1}{100}\right\} \leqq D \leqq k\left\{\frac{0.14a}{2+0.2a}-\frac{1}{1500}\right\} \quad (1)$$

(b) When 0.5 m $\leqq$ R $<$ 1.0 m $$k\left\{\frac{0.13a}{2+0.5a}-\frac{1}{100}\right\} \leqq D \leqq k\left\{\frac{0.42a}{2+0.2a}-\frac{1}{1500}\right\} \quad (2)$$

(c) When 1.0 m $\leqq$ R $<$ 2.0 m $$k\left\{\frac{0.26a}{2+0.5a}-\frac{1}{100}\right\} \leqq D \leqq k\left\{\frac{0.84a}{2+0.2a}-\frac{1}{1500}\right\} \quad (3)$$

in the formulae (1), (2) and (3),

T is the wall thickness (m) of the steel ingot, D is the thickness (m) of the refractory material, a is T/R, and k is the thermal conductivity (Kcal/m·h·°C.) of the refractory material.

4. A method of producing a hollow steel ingot as set forth in claim 2, wherein the flow rate of said gas stream for cooling the core is set at 0.5 to 5 m/sec.

5. A casting apparatus for producing a hollow steel ingot comprising a cast iron mold installed on a stool, a cylindrical core disposed in the central portion of said mold and pouring gates formed through the stool for feeding molten steel at intermediate portions between the inner wall of said mold and the core, wherein said apparatus further comprises: a first steel pipe disposed in the central portion of said mold; a second steel pipe disposed within said first steel pipe and concentrically therewith; said core made of granular refractory material filled up in a space formed between said first and second steel pipes; a third steel pipe further disposed within said second steel pipe and concentrically therewith; and a gas flow course for cooling the core descending into said third steel pipe from above and then ascending inside said second pipe.

6. A casting apparatus for producing a hollow steel ingot as set forth in claim 5, wherein a plurality of reinforcing ribs are provided which connect the inner side of said second steel pipe to the outer side of said third steel pipe in the radial direction to support said pipes.

7. A casting apparatus for producing a hollow steel ingot as set forth in claim 6, wherein, in the case the thickness of said second steel pipe: t (cm), the inner radius of said second steel pipe: R (cm), the height of the steel ingot to be produced: H (m), the total cross-sectional area of the gas flow course between said second and third steel pipes: S ($cm^2$), and the number of the reinforcing ribs in said cooling gas flow course: n ($n \geqq 2$), then the following three formulae (1), (2) and (3) are satisfied:

$$t \geqq 0.030[H/(n^2-1)]^{\frac{1}{2}} \cdot R \quad (1)$$

$$t \geqq 0.0047\ HR \quad (2)$$

$$S \geqq 5.9\ HR \quad (3).$$

8. A casting apparatus for producing a hollow steel ingot as set forth in claim 5, wherein, said granular refractory material comprises the combination of furan or urethane resin with one or two members selected from the group consisting of silica sand, zircon sand and chromite sand.

* * * * *